US005287606A

United States Patent [19]

Ruef

[11] Patent Number: 5,287,606

[45] Date of Patent: Feb. 22, 1994

[54] APPARATUS FOR TREATING TRAVELING TEXTILE MATERIAL IN A PRESSURIZED FLUID

[75] Inventor: Helmut Ruef, Charlotte, N.C.

[73] Assignee: Soft Blast, Inc., Charlotte, N.C.

[21] Appl. No.: 910,716

[22] Filed: Jul. 7, 1992

Related U.S. Application Data

[63] Continuation-in-part of Ser. No. 849,287, Mar. 10, 1992, abandoned.

[51] Int. Cl.[5] ..... D02G 1/00; F26B 3/00; B08B 3/12

[52] U.S. Cl. ..... 28/219; 28/247; 34/23; 34/155; 34/242; 68/5 E

[58] Field of Search ..... 28/247, 248, 249, 219; 34/23, 155, 156, 242; 277/53, 54; 68/5 E

[56] References Cited

U.S. PATENT DOCUMENTS

| | | | |
|---|---|---|---|
| 2,571,815 | 10/1951 | Benoit et al. | 34/155 X |
| 2,838,420 | 6/1958 | Valente | 34/23 |
| 3,349,578 | 10/1967 | Greer et al. | 68/5 E |
| 3,802,038 | 4/1974 | Bauch et al. | 28/248 X |
| 4,087,992 | 5/1978 | Sando et al. | 68/5 E |
| 4,255,037 | 3/1981 | Meadows et al. | 34/155 X |
| 4,622,761 | 11/1986 | Barth | 34/155 |
| 4,872,270 | 10/1989 | Fronheiser et al. | 34/23 |
| 4,980,979 | 1/1991 | Wedel | 34/23 |

OTHER PUBLICATIONS

Dipl.-Ing. Klaus Meier, "Texturizing and treatment of filaments-higher speeds, processing data acquisition and automation", ITB Yarn Forming, pp. 70-72, Apr. 1991.

Subhas Ghosh and Don Alexander, "Einfluss von Garnschrumpf bei der Vorfixierung und Thermofixiertemperatur auf Bausch und Farbstoffaufnahme von BCF-Polyamid", *Melland Textilberichte*, pp. 545-546, Jul. 1990.

Prof. Dr.-Ing. Burkhard Wulfhorst and Dipl.-Ing. Klaus Meier, "Simulation der Fadenerwaermung im Falschdrahttexturierprozess", *Melland Textilberichte*, pp. 695-700, Sep. 1991.

Technical Brochure regarding FK6M-900 2,0/1,5 Texturizing Machine (undated).

Dipl.-Ing. Klaus Meier and Prof. Dr.-Ing. Burkhard Wulfhorst, "Ausbildung der Luftstroemung um den Faden beim Falschraht-Texturieren", *Melland Textilberichte*, pp. 7-8, Jan. 1992.

"Nachfixieren von Filamentgarnen bei hohen Texturiergeschwindigkeiten (Set-Prozess)" (German language article-undated).

*Primary Examiner*—Clifford D. Crowder
*Assistant Examiner*—Bibhu Mohanty
*Attorney, Agent, or Firm*—Shefte, Pinckney & Sawyer

[57] ABSTRACT

An apparatus for treating traveling textile material in a pressurized fluid, e.g., for heating synthetic filaments to a heat-set temperature in a saturated steam atmosphere is disclosed to comprise a housing defining at least one upstream sealing chamber, an intermediate treatment chamber pressurized with saturated steam, and at least one downstream sealing chamber, separated from one another by constricted strand passageways for traveling movement of the strand successively through the chambers. A pressurized fluid holding chamber is provided between the steam supply and the treatment chamber to reduce condensation within the treatment chamber and the sealing chambers. The sealing chambers and the constricted passageways cooperate to cause the pressurized steam or other treating fluid escaping into the sealing chambers from the treatment chamber to expand sufficiently so that the housing is generally sealed from substantial loss of the steam or other treating fluid and the treatment chamber is sustained substantially pressurized, without the use of mechanical seals and substantially without physically contacting the traveling strand. A venturi nozzle at the downstream end of the housing provides easy suction thread-up of the strand eliminating any need for openability of the housing, which simplifies and reduces the cost of housing construction. Alternatively, a needle or other threading implement may be provided for attachment thereto of a leading end of the strand to guide passage of the strand through the apparatus. A shutter assembly may be associated with the passageways to selectively open them for material thread-up and close them into a constricted state for normal operation.

21 Claims, 5 Drawing Sheets

APPARATUS FOR TREATING TRAVELING TEXTILE MATERIAL IN A PRESSURIZED FLUID

CROSS REFERENCE TO RELATED APPLICATION

This is a continuation-in-part of co-pending U.S. patent application Ser. No. 849,287, filed Mar. 10, 1992, entitled APPARATUS FOR TREATING A TRAVELING TEXTILE STRAND IN A PRESSURIZED FLUID now abandoned.

BACKGROUND OF THE INVENTION

The present invention relates generally to an apparatus for treating a traveling textile material, particularly filament, yarn, or other strand-like material, in a pressurized fluid and, more particularly, to an apparatus for heating traveling textile strands to a heat-set temperature in a pressurized saturated steam atmosphere, such as preliminary to a texturizing operation.

In typical conventional apparatus for texturizing textile strands, a heating apparatus is provided through which the strand is directed to travel preliminarily to elevate the temperature of the strand to a predetermined heat-set temperature. One of the more common heating apparatus utilized for this purpose is a contact heater wherein the strand travels in a groove formed in a heating plate whose temperature is controlled to approximate the desired heat-set temperature. As is well-known, the temperature to which the strand is heated is a function not only of the temperature of the heating plate itself, but also the residence time spent by the traveling strand within the heater, which is determined by the traveling speed of the strand and the length of the groove formed in the heating plate. In recent years, the textile industry has increasingly demanded texturizing equipment capable of operating at ever higher strand traveling speeds, which objective has been addressed in basically two ways. First, texturizing equipment has been offered with heating apparatus of increasing lengths so as to achieve requisite strand residence times within the heaters and, in turn, sufficient heating to a desired heat-set temperature at increased strand traveling speeds. Second, more recently, texturizing equipment has become available utilizing heaters which generate a considerably higher strand-heating temperature than the desired heat-set temperature so as to accomplish sufficient strand heating within a shorter strand traveling distance while the strand travels at an elevated speed.

Disadvantages exist in both types of heating apparatus. More elongated heating apparatus of the first above-mentioned type may be as long as 2.5 meters and, accordingly, require considerably more space within the textile plant. Typically, to minimize the floor space occupied by such texturizing equipment, the heaters are oriented vertically, causing the apparatus to be of a considerable height. To attempt to reduce the height of texturizing equipment heaters, some equipment orient the heaters at an upward angle or, alternatively, configure the heaters to define an arcuate or circular strand traveling path. In either case, a greater floor space is occupied by the heating apparatus than with vertically-oriented heaters. Moreover, inclined or arcuate heaters additionally tend to cause a greater degree of frictional contact between the traveling strand and the groove within the heater plate which can produce damage to the traveling strand, cause excessive deposits of polymeric strand material and strand finishings to collect within the heater groove requiring periodic cleaning to maintain efficient heat transfer and minimize strand breakages, and otherwise deleteriously affect the texturizing process. It has also been found that more elongated heater sections in texturizing equipment can produce instabilities and surging within the strand heating zone, which does not typically occur in texturizing equipment whose heaters are shorter in length and operate at a lower strand traveling speed.

In texturizing equipment utilizing shorter length heaters operable at more elevated temperatures, often in the range of up to 600° C., substantially greater energy must be generated to accomplish heating to such elevated temperatures, thereby correspondingly increasing the cost of operating the equipment. Furthermore, a greater risk exists in operating such equipment that the cross section of the strand can be rendered nonuniform by crystallizing the outermost portions of the strand to a greater degree than the strand core. The similar danger exists of severely damaging the strand by melting upon periodic stoppages of the equipment. Thus, it is critical in such equipment that the temperature of the heater and the traveling speed of the strand be closely monitored and carefully controlled to minimize these risks.

Similar disadvantages exist in conventional commercial equipment for heat-setting carpet yarns, wherein the objective is to stabilize the yarn bulk, to return the yarn to a fully relaxed state by relieving inner molecular tension within the strand structure, and to increase its crystallinity for better and more uniform dye pick-up. For this purpose, commercial carpet yarn heat-setting equipment typically accomplish heat-setting by directing the yarn to travel in a low tensioned state through a dry heat atmosphere or in a steam atmosphere at ambient pressure or a slightly elevated pressure. However, since the steam atmosphere generated in such equipment is typically at a temperature below a desired heat-setting temperature and since heat transfer from a dry heat atmosphere to a traveling strand is relatively inefficient, such conventional heat-setting equipment must be of a relatively significant length to achieve a sufficient dwell time of the traveling carpet yarn within the heater to obtain desired heat-setting results.

SUMMARY OF THE INVENTION

It is accordingly an object of the present invention to provide a novel apparatus by which a traveling textile material, such as yarns, filaments, and other strand-like materials as well as other textile materials in web-like or other open-width or flat form, can be effectively and efficiently heat-set while traveling at relatively high linear speeds without requiring the heat-setting equipment to be of a significant length and also without subjecting the textile material to a significant risk of damage.

According to the present invention, this objective is accomplished by providing an apparatus wherein traveling textile material can be treated in a pressurized fluid, the apparatus being particularly useful for heat-setting traveling material formed as a strand in a pressurized saturated steam atmosphere.

Briefly summarized, the apparatus of the present invention basically includes a housing structure which defines a series of chambers through which the textile material can be directed to travel successively. The chambers include a central treatment chamber which is communicated with a supply of a suitable pressurized material treating fluid, e.g., saturated steam under pressure. To minimize escape of the pressurized treating fluid from the housing structure, a first sealing chamber is provided at the upstream side of the treatment chamber and a second similar sealing chamber is provided at the downstream side of the treatment chamber, the housing structure being suitably configured to define constricted material passageways at the opposite ends of each of the upstream sealing chamber, the treatment chamber, and the downstream sealing chamber. In this manner, the sealing chambers and the constricted passageways at their respective entrance and exit sides are cooperative to allow pressurized treating fluid escaping into the sealing chambers from the treatment chamber to expand sufficiently within the sealing chambers so that the housing structure is generally sealed from substantial loss of the pressurized treating fluid and, in turn, substantially maintains desired pressurization of the treatment chamber.

In one preferred embodiment of the apparatus, saturated steam under pressure is applied to the treatment chamber to enable the apparatus to be used in a textile texturizing line for initially heating a traveling textile material, typically formed as a strand, to its heat-set temperature. In such embodiment, a plurality of expansion chambers are preferably provided downstream of the pressurized treatment chamber to enhance the described sealing effect. Generally, a lesser number of upstream sealing chambers will be necessary since pressurized steam escaping into the upstream sealing chamber will naturally tend to condense therein as a result of being continuously exposed to the relatively cooler incoming textile material, thereby serving to continuously depressurize the upstream sealing chamber and, in turn, minimize escape of pressurized treatment fluid therefrom outwardly of the housing structure. In addition, the continual condensation of escaping steam within the upstream chamber serves the beneficial advantage of preheating the incoming material in advance of entering the treatment chamber.

Preferably, each constricted passageway is dimensioned to be sufficiently larger in cross-sectional area than the material being treated in the apparatus to avoid contact with the material, yet sufficiently constricted to control escape of pressurized treating fluid through the passageway. It is also preferred that each of the constricted passageways is configured to be of an increasing dimension in the direction outwardly away from the treatment chamber in order to maximize resistance to entrance of escaping pressurized treating fluid into the more constricted end of each passageway most closely adjacent the treatment chamber and to promote expansion within the sealing chambers of the pressurized treating fluid which actually escapes, thereby to maximize the pressure drop from the treatment chamber to the sealing chambers and, in turn, minimize ultimate escape of treating fluid from the overall housing structure.

The housing may be provided with an annular fluid holding chamber formed annularly about the treatment chamber. The fluid supply is communicated with the holding chamber which, in turn, is communicated at a spaced location with the treatment chamber. By utilizing a holding chamber for the steam or other pressurized treating fluid prior to its passage into the treatment chamber, condensation in all chambers is reduced.

As necessary or desirable, a detector may be provided for monitoring the temperature of the steam or other treating fluid, e.g., within the holding chamber or within the treatment chamber, and an associated regulator may be utilized for controlling the delivery of the fluid into the treatment chamber in relation to the detected temperature.

To facilitate easy thread-up of a textile strand or other material through the housing structure, a nozzle device is preferably provided at the downstream end of the housing structure and is connected with a suitable source of pressurized fluid, such as air, to enable creation of a sufficient negative pressure within the series of chambers to accomplish suction thread-up of a material successively through the chambers preliminary to beginning operation of the apparatus. A regulator arrangement can be provided in conjunction with the nozzle device to allow selective delivery of the pressurized air to the nozzle device at a relatively higher rate for purposes of suction material thread-up and at a relatively lower rate for purposes of material cooling during normal operation of the apparatus. Also, an arrangement can be provided to enable a coolant, such as water, to be delivered to the nozzle device for mixing with the pressurized cooling air.

Alternatively, a threading implement, e.g., a needle-like implement or other auxiliary device which can be passed through the series of chambers, may be provided for attachment thereto of a leading end of the textile strand or other material and then utilized for guiding passage of the leading end of the material through the housing for thread-up.

A pressure relief valve may be associated with the upstream sealing chamber or the downstream sealing chamber or both for controlled venting thereof to the ambient atmosphere progressively over the course of operation of the apparatus, so that air and treating fluid captured within the upstream sealing chamber is caused to escape laterally outwardly from the chamber rather than through the same constricted passageway through which the traveling strand or other material enters. In this manner, the entire amount of excess vented fluid may be collected for recirculation or other recycling, thus making the treating system substantially closed.

It may also be beneficial to provide a suitable arrangement for delivering another supply of pressurized fluid, preferably pressurized air, into the downstream sealing chamber, or the most downstream sealing chamber in embodiments having multiple downstream sealing chambers, to counteract any tendency of the pressurized treating fluid to escape downstream from the treatment chamber and thereby to retard the escape of the pressurized treating fluid. A similar supply of pressurized air can be delivered into the upstream sealing chamber but is considered unnecessary.

DESCRIPTION OF THE PREFERRED EMBODIMENT

Figure 1:
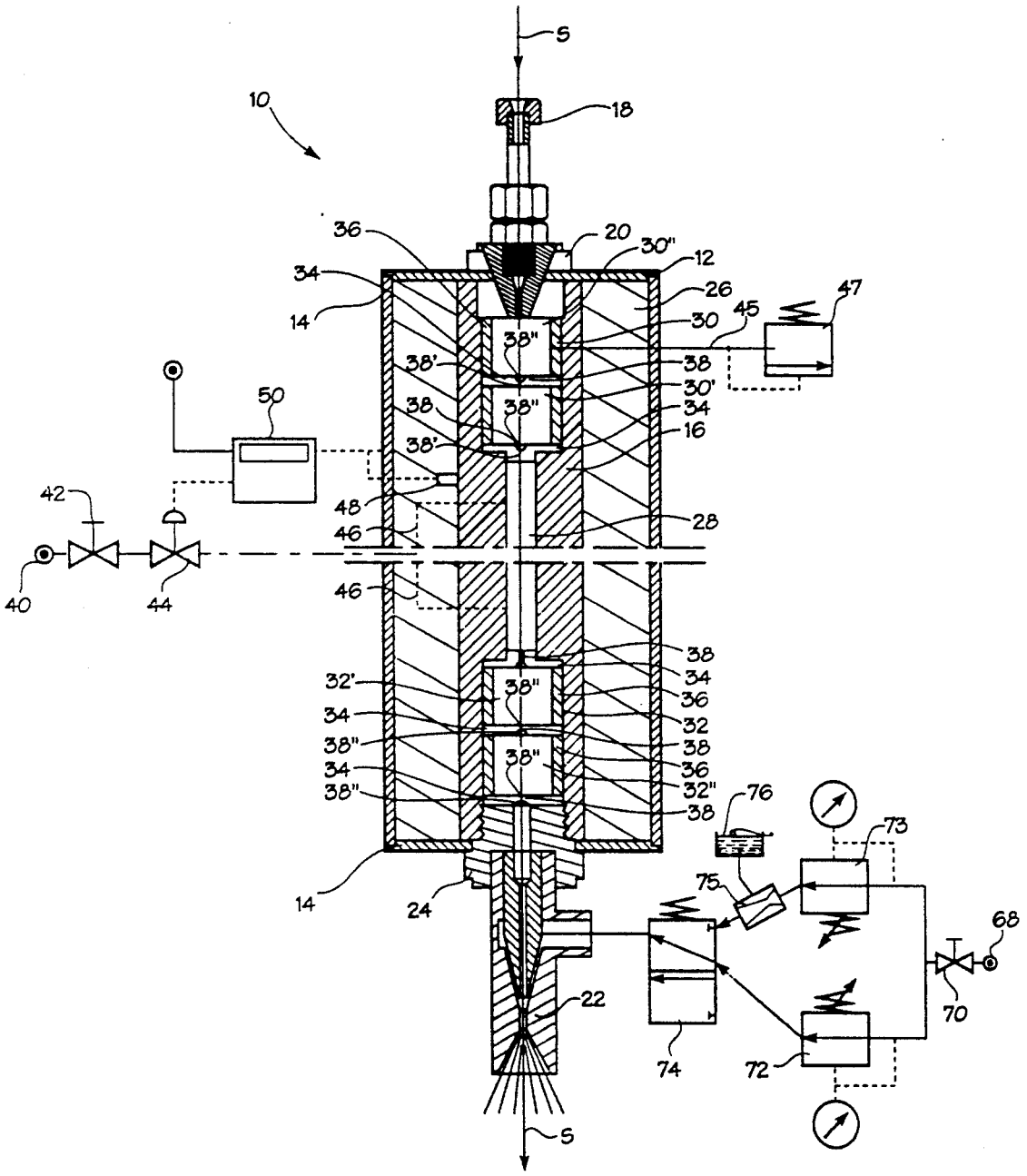
FIG. 1 is a schematic lengthwise cross-sectional view of a textile material treating apparatus according to the preferred embodiment of the present invention.

Referring now to the accompanying drawings and initially to FIG. 1, an apparatus for treating a traveling textile material in a pressurized fluid atmosphere according to a preferred embodiment of the present invention is indicated generally at 10. It is contemplated that the present invention is susceptible to differing embodiments for treating a variety of textile materials, which may include filaments, yarns, and other strand-like materials as well as tapes, belts, fabrics, carpets, and like materials in a web-like or other flat or open-width form, utilizing a variety of possible treating fluids, e.g., saturated steam. The invention is herein illustrated and described in embodiments adapted for pressurized steam heat-setting of synthetic filamentary strands, but it is to be understood by those persons skilled in the art that the invention is of a broader utility and application.

Basically, the apparatus 10 comprises a housing structure 12 formed of an elongated outer shell 14 through the center of which extends lengthwise a hollow pressure tube 16 for travel therethrough of a strand S from an upstream end 16' to a downstream end 16" of the pressure tube 16. A strand infeed tube 18 is secured co-axially to the upstream end 16' of the pressure tube 16 by a cap screw 20 and, similarly, a venturi-type thread-up nozzle 22 is co-axially secured at the downstream end 16" of the pressure tube 16 by another cap screw 24. The annular space between the housing shell 14 and the pressure tube 16 is filled with an appropriate insulating material 26.

The annular interior surface of the pressure tube 16 is of a stepped configuration to define an elongate pressure chamber 28 substantially intermediately along the length of the pressure tube 16 and upstream and downstream expansion chambers 30,32, respectively, of a relatively enlarged cross-sectional diameter. A series of nozzle plates 34 and cylindrical spacer rings 36 serve to separate the pressure chamber 28 from the upstream and downstream expansion chambers 30,32, and also to subdivide each expansion chamber 30,32 into two or more serially-arranged sealing subchambers 30',30",32',32", respectively. Each nozzle plate 34 is formed with a constricted passageway 38 located centrally in co-axial relation to the pressure tube 16, each passageway 38 having a relatively narrow cylindrical entrance bore 38' formed at the side of its respective nozzle plate 34 facing the pressure chamber 28 and an adjoining outwardly tapering conical exit bore 38" opening outwardly at the opposite side of its respective nozzle plate 34 facing away from the pressure chamber 28.

A suitable source of supply of pressurized saturated steam, shown only representatively at 40, is communicated with the pressure chamber 28 sequentially through a shut-off valve 42, a variably openable regulator valve 44, and a branching tubular conduit 46 extending laterally through the housing shell 14 and the pressure tube 16 to open transversely into the interior of the pressure chamber 28. A temperature sensor 48 is mounted to the pressure tube 16 to extend into the pressure chamber 28 for monitoring the steam temperature within the chamber 28 and is operatively connected with a control unit 50 connected to the regulator valve 44 and pneumatically operated by a source of pressurized air 52 to variably control opening and closing movements of the regulator valve 44 to regulate the supply of steam delivered into the pressure chamber 28 in relation to its prevailing internal temperature.

Another tubular conduit 45 extends laterally through the housing shell 14 and the pressure tube 16 to open transversely into the most upstream sealing subchamber 30", the conduit 45 being connected exteriorly of the housing structure 12 with an adjustable venting or pressure relief valve 47, to provide controlled venting of the subchamber 30" to the ambient atmosphere or to another suitable discharge location. Alternatively, or in addition, the most downstream sealing chamber 32" may be similarly vented and the excess vented steam or other treating fluid may be collected for recirculation or recycling, making the treating fluid system substantially enclosed.

The venturi nozzle 22 is communicated with a source of pressurized fluid 68, preferably air, through a shut-off valve 70, a pair of pressure regulating units 72,73, arranged in parallel relation with one another, and a common three-way selector valve 74. As more fully explained hereinafter, the pressure regulating unit 72 is adjusted to permit passage therethrough of the pressurized fluid at a relatively high rate, while the pressure regulating unit 73 is adjusted for pressurized fluid flow at a relatively lower rate. The selector valve 74 permits the pressure regulating units 72,73 to be alternatively communicated with the venturi nozzle 22. Optionally, the branch of the pressurized fluid supply line between the pressure regulating unit 73 and the selector valve 74 can be provided with an aspiration nozzle 75 which is communicated with a water tank 76 operable through a conventional float valve arrangement to maintain a suitable quantity of water therein.

The operation of the present apparatus may thus be understood. In an initial thread-up mode of the apparatus, the steam shut-off valve 42 to the pressure chamber 28 is closed, the pressurized fluid shut-off valve 70 to the venturi nozzle 22 is opened, and the selector valve 74 is positioned for communicating the high flow rate regulating unit 72 with the venturi nozzle 22, to create a relatively strong negative suction pressure through the series of chambers defined within the pressure tube 16. Thus, upon threading of a leading end of the textile strand S through the infeed tube 18, the strand S is drawn lengthwise through the series of chambers and the passageways 38 in the intervening nozzle plates 34 and then through the venturi nozzle 22, to automatically thread the strand S through the housing 12. Thereupon, the pressurized fluid shut-off valve 70 to the venturi nozzle 22 is closed or, alternatively, the selector valve 74 is repositioned to communicate the venturi nozzle 22 with the low flow rate regulating unit 73, and the steam shut-off valve 42 is opened to deliver pressurized saturated steam into the pressure chamber 28. Preferably, the steam is sufficiently pressurized to create a saturated steam atmosphere within the pressure chamber 28 on the order of about 250 psi or more.

As the strand S travels through the apparatus 10, the strand is subjected to a highly efficient heating within the pressure chamber 28, as more fully discussed below. As will be recognized, the pressurization of the chamber 28 will naturally tend to be relieved by escape of steam outwardly from the chamber 28 in both upstream and downstream directions through the passageways 38 in the adjacent upstream and downstream nozzle plates 34. Advantageously, however, the constricted cylindrical entrance bores 38' of each passageway 38 tend to resist escape of pressurized steam therethrough and, complementary thereto, the conical exit bore 38" of each passageway 38 tends to promote laterally outward expansion within the adjacent sealing subchambers 30',32' of any steam which does escape, the overall effect of which is to maximize the pressure drop across the nozzle plates 34 between the pressure chamber 28 and the adjacent upstream and downstream sealing subchambers 30',32'. A corresponding effect is achieved with respect to steam escaping from the sealing subchambers 30',32' into the most upstream and downstream sealing subchambers 30",32", further increasing the pressure differential between these subchambers and the pressure chamber 28. This effect is even more dramatic within the upstream sealing subchambers 30',30" because the relatively cooler incoming strand S tends to promote condensation and resultant depressurization of the escaping steam within these subchambers.

Thus, in net effect, the provision in the present invention of the subchambers 30',30",32',32" serves to effectively seal the housing 12 of the present apparatus from escape of pressurized steam, or other pressurized treating fluid, without the use of any mechanical sealing means requiring undesirable contact with the traveling strand S.

The adjustable pressure venting valve 47 serves to relieve any pressure build-up possibly occurring within the most upstream sealing subchamber 30" so as to insure that the internal pressure of this subchamber is maintained at a desirably low level. In addition, by discharging fluid from the sealing subchamber 30" laterally through the conduit 45, any polymeric material, finishing, or the like released from the incoming strand S is progressively discharged through the conduit 45 rather than through the infeed tube 18, thereby minimizing any tendency of such materials to collect and become deposited within the infeed tube 18 and, in turn, minimizing the need to periodically clean its strand passageway.

With the selector valve 74 positioned to communicate the venturi nozzle 22 with the regulating unit 73, the relatively low rate of pressurized fluid thereby admitted into the nozzle 22 serves to cool the heated strand S prior to discharge from the apparatus 10. Additional cooling effect can be achieved by aspiration of water from the tank 76 into the venturi nozzle 22 as the strand S is discharged.

Distinct and important advantages are realized in the use of the present invention in comparison to conventional strand heating apparatus of the type described above. Given the known high co-efficient of heat transfer achieved by condensing steam, it will be recognized by those persons skilled in the art that the heating apparatus of the present invention can be constructed of a substantially shorter overall effective length and still operate effectively for heating textile strands to their heat-set temperature while traveling at increased linear speeds in comparison with the capabilities of conventional heaters utilized in known texturizing equipment.

According to calculations published by the Institut Fuer Textiltechnik of the RWTH Aachen, Germany, the theoretically shortest time required for heat-up of synthetic filament yarns achievable in heaters of texturizing machines is 0.135 ms/dtex (milliseconds per decitex) for polyester and 0.15 ms/dtex for the polyamide 6.6 (nylon). Thus, by way of example, assuming a polyester yarn of an average size of about 167 decitex traveling at a speed of 1,000 meters per minute and assuming that the temperature of steam prevailing within the pressure chamber 28 of the present apparatus is maintained exactly at the heat-set temperature of polyester, it can be calculated that the pressure chamber 28 need be of a length of only about 0.375 meters in order for the polyester yarn to be effectively heated to its heat-set temperature while traveling at such speed. Of course, it will be equally recognized that the pressure chamber could be of an even shorter length if the steam temperature is maintained above the polyester heat-set temperature.

In addition, the present apparatus enables significant energy savings to be realized in that steam is much higher in efficiency in heating up textile strands in comparison to electrically-operated heater plates and, further, a generally lower expense is incurred to generate heat energy by steam as compared to electricity. The provision of the venturi nozzle for strand thread-up provides the important advantage of avoiding any necessity that the housing structure be openable for interior access, thereby enabling the housing to be constructed as a permanently closed structure which minimizes potential sealing problems, simplifies construction, and reduces overall manufacturing cost. Finally, the present apparatus achieves effective strand heating without any contact with the traveling strand, promoting improved yarn quality and minimizing deposits of finish and polymer within the texturizing equipment.

Figure 2:
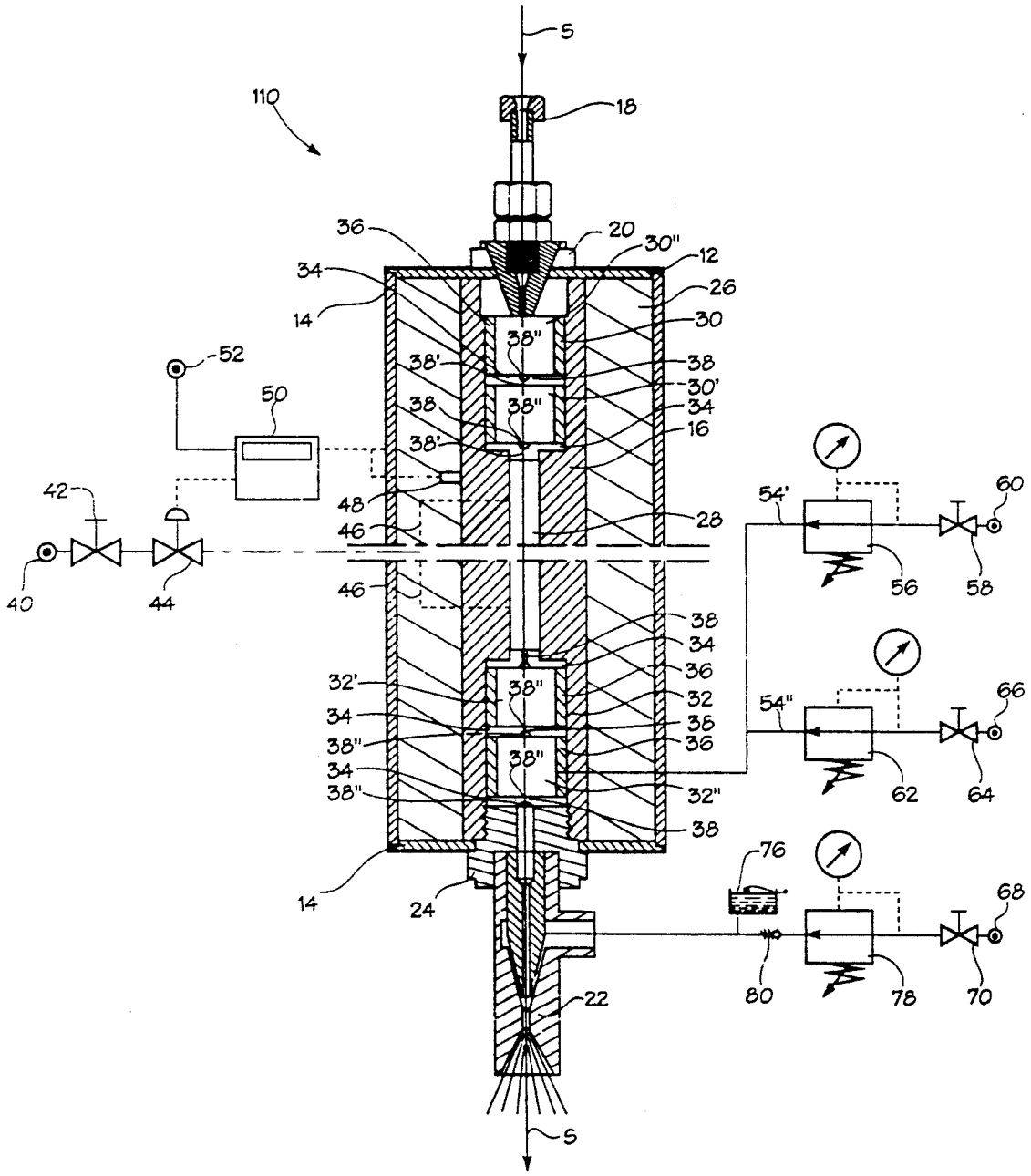
FIG. 2 is another schematic lengthwise cross-sectional view of a textile material treating apparatus according to an alternative embodiment of the present invention.

An alternative embodiment of the present strand treating apparatus is indicated generally at 110 in FIG. 2, wherein components which correspond to the apparatus 10 of FIG. 1 are identified by like reference numerals. The treating apparatus 110 of FIG. 2 is substantially identical in construction and operation to the apparatus 10 of FIG. 1, except as follows. In the apparatus 110 of FIG. 2, a tubular conduit 54 extends laterally through the housing shell 14 and the pressure tube 16 to open transversely into the most downstream sealing subchamber 32' and the conduit 54 is connected exteriorly of the housing 12 through a first branch conduit 54', a regulator unit 56, and a shut-off valve 58 with a source of pressurized air 60 and through another branch conduit 54", a corresponding regulator 62, and a shut-off valve 64 with a source of pressurized water 66. Also, only a single adjustable pressure regulating unit 78 is provided in the pressurized air supply line to the venturi nozzle 22, with a check valve 80 being located in the supply line between the pressure regulating unit 78 and the venturi nozzle 22 and with the water tank 76 being connected in the supply line between the check valve 80 and the nozzle 22.

In operation, the pressure regulating unit 78 can be selectively adjusted to deliver pressurized air or another fluid to the venturi nozzle 22 at relatively high or relatively low rates to accommodate initial strand thread-up and also to accommodate, if desired, a lesser rate of pressurized fluid supply to the nozzle 22 along with aspirated water from the tank 76 for strand cooling during normal operation of the apparatus 110. During the thread-up mode, the air and water shut-off valves 58,64 are closed along with the steam shut-off valve 42. During normal ongoing operation of the apparatus 110 for steam heating treatment of the traveling strand S, the operator has the option of leaving the air and water shut-off valves 58,64 closed or alternatively opening one or both valves 58,64 to deliver a respective pressurized fluid or fluid mixture into the most downstream sealing chamber 32'', thereby to counteract and retard the downstream escape of steam from the pressure chamber 28, while also serving to cool the heated strand S prior to discharge from the apparatus 10. Otherwise, operation of the apparatus 110 is substantially the same as described above for the apparatus 10 of FIG. 1.

Figure 3:
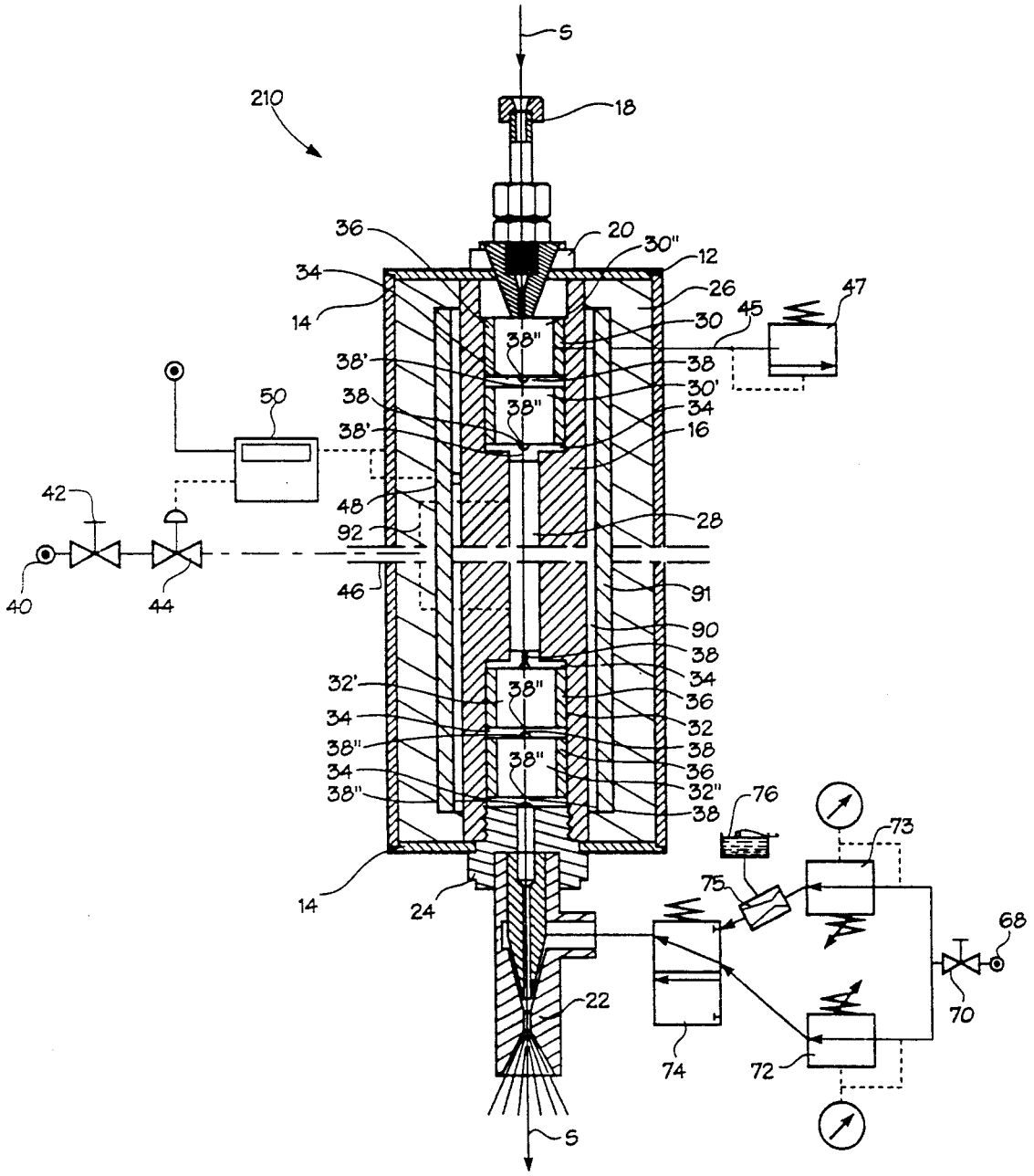
FIG. 3 is another schematic lengthwise cross-sectional view of a textile material treating apparatus according to another alternative embodiment of the present invention.

With reference to FIG. 3, in another alternative embodiment of the apparatus of the present invention indicated at 210, the housing 12 defines an annular fluid holding chamber 90 annularly about the pressure chamber 28 by means of a hollow cylinder 91 disposed at a close spacing, e.g., 1 to 3 millimeters, concentrically about the pressure tube 16 along the full length of the pressure and expansion chambers 28,30,32. The holding chamber 90 communicates with the pressure chamber 28 at a plurality of locations, e.g., through a pair of bores 92 extending transversely therebetween at an axial spacing through the pressure tube 16. Steam is supplied to the holding chamber 90 at an axial spacing from the bores 92 through the aforementioned tubular supply conduit 46 which no longer branches as in the previous embodiments. It should be noted that steam may be supplied substantially midway between the bores 92 or may be supplied at other locations depending on tube orientation. The presence of the holding chamber 90 as an intermediate holding area for the steam before it passes into the pressure chamber 28 insures that the steam temperature in the holding chamber 90 is always at least slightly higher than in the pressure and expansions chambers 28,30,32, thereby significantly reducing the occurrence of condensation within the pressure chamber 28 and the expansion chambers 30,32. Under some circumstances, excess condensation could leave deposits of finishing oils, polymers, and other residue from the strand S or other textile material on the walls of the chambers which would require frequent cleaning of the interior of the pressure tube 16. In this embodiment, the temperature sensor 48 may be mounted to the annular cylinder 91 to extend into the holding chamber 90 for control of the regulator valve 44 based on the prevailing internal steam temperature within the holding chamber 90.

Figure 4:
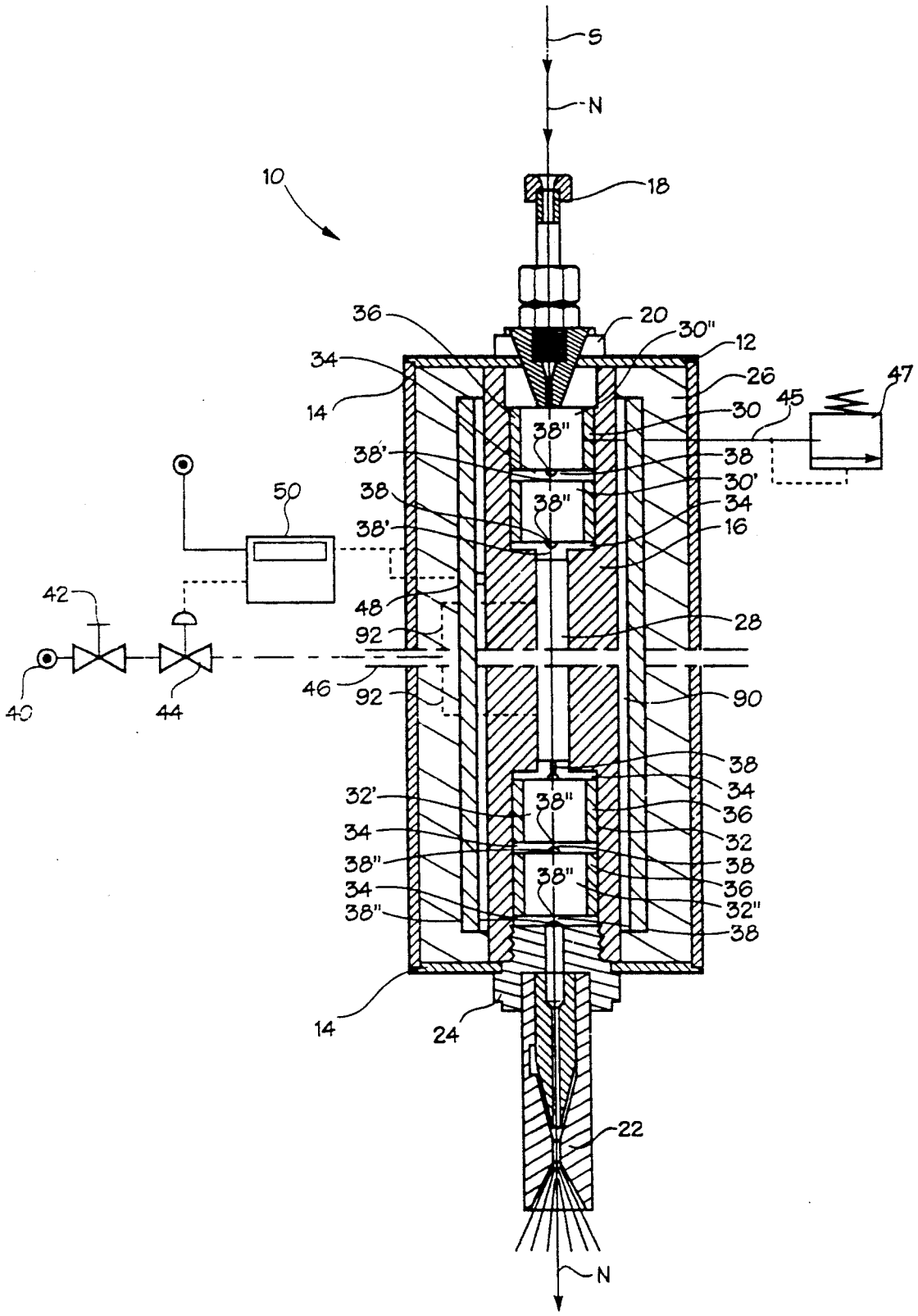
FIG. 4 is a schematic lengthwise cross-sectional view of a textile material treating apparatus according to the present invention, illustrating an alternate method of thread-up thereof.

With reference to FIG. 4, an alternative method of material thread-up is illustrated. A needle N is attached to a leading end of the strand S (or other textile material) and is then inserted through the infeed tube 18 and passed downwardly therefrom through the successive chambers of the pressure tube 16 to emerge outwardly through an exit tube 122. The needle N may be of a greater length than the overall apparatus 10 for insuring complete passage through the apparatus or, alternatively, if the apparatus 10 is disposed vertically as illustrated, the needle N may be shorter in length but sufficiently weighted to pass gravitationally through the entire apparatus. In either case, the needle N serves to guide passage of the strand or other material by its leading end through the apparatus to achieve thread-up thereof.

Of course, those persons skilled in the art will recognize that alternative threading implements could also be used to guide a leading end of the strand or other material through the apparatus. For example, the apparatus could be equipped with a leader strand extending through the chambers of the housing between supply and take-up reels at opposite housing ends for drawing a leading end of material through the apparatus for thread-up.

Figure 5:
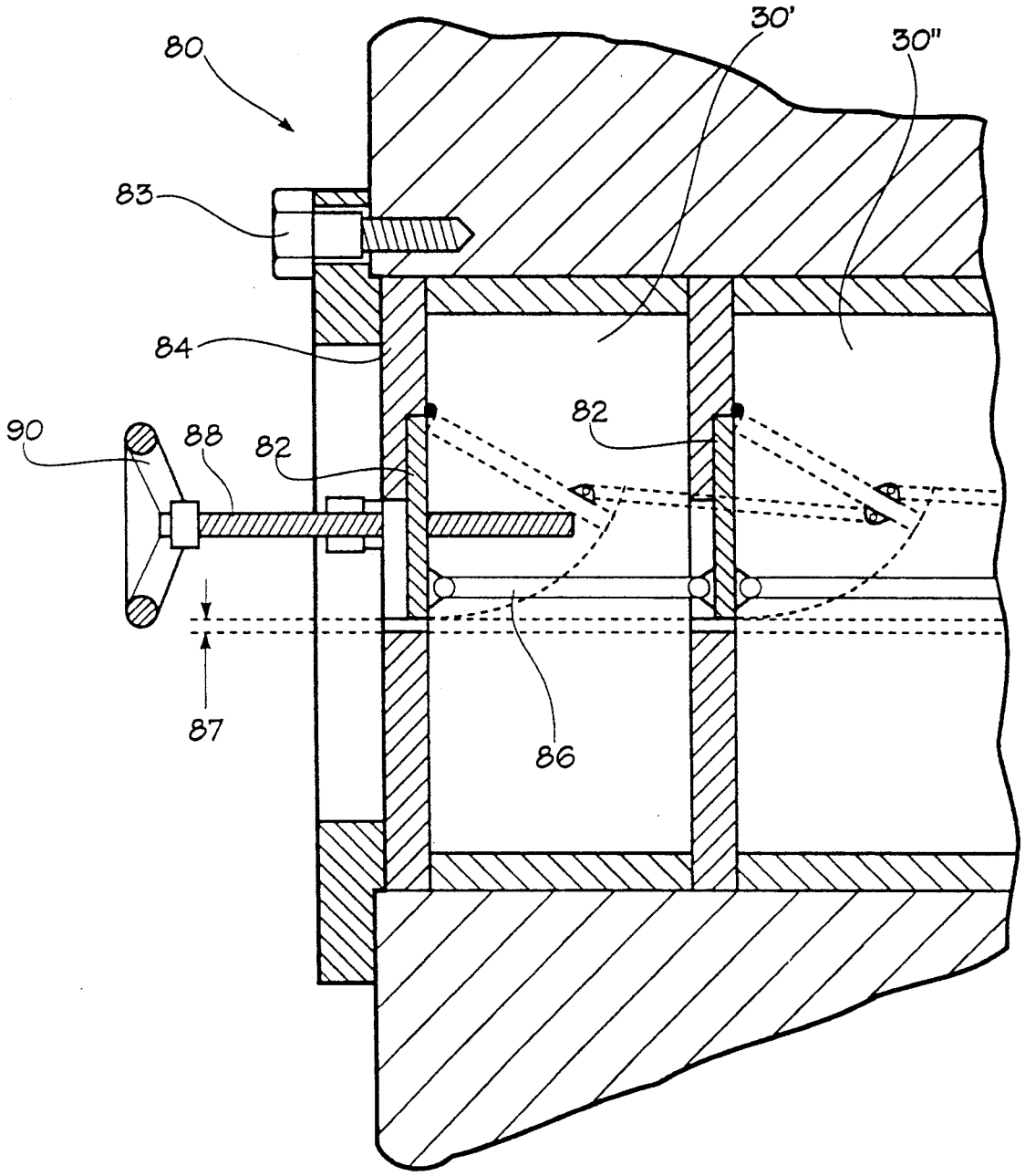
FIG. 5 is a schematic cross-sectional view of a shutter assembly according to an alternate embodiment of the present invention.

With reference to FIG. 5, another alternative means and method of material thread-up is provided which is especially suited for processing of tows, other multiple filament materials, warp sheets, ribbons, tapes, or other sheet or web-like or flat open-width materials. For material thread-up purposes in such embodiments, the infeed tube 18 and nozzle 22 would be replaced by a shutter assembly 80 mounted to each opposite end of the apparatus by conventional bolts 83 to provide for material entrance and exit to and from each of the upstream and downstream expansion chambers 30,32.

By way of example, FIG. 5 depicts the shutter assembly 80 at the material entrance end of the apparatus 10. In this embodiment, the subchambers 30',30'' are separated from one another and from the central pressure chamber by dividing plates 84 formed with enlarged rectangular openings 85 aligned with one another. The shutter assembly 80 includes a plurality of shutter plates 82, each shutter plate 82 being generally rectangular in shape and pivotally mounted to a respective one of the dividing plates 84 at the entrance to each upstream subchamber 30',30'', and to the pressure chamber for opening and closing the respective openings 85. The shutter plates 82 are arranged to leave a narrow elongated rectangular passageway 87 between each shutter plate 82 and its respective dividing plate 84 in the fully closed position of the shutter plates sufficient that the textile material may pass therethrough in normal operational traveling movement through the apparatus. The shutter plates 82 in the shutter assembly 80 are linked to each other by a series of link members 86 each extending between and pivotally mounted to a successively adjacent pair of shutter plates 82 for coordinated opening and closing movement of the shutter plates 82. A drive screw 88 extends threadably through the dividing plate 84 at the entrance to the first subchamber 30' into abutment with the respective shutter plate 82. The outward end of the drive screw 88 carries a drive wheel 90 mounted thereto for manual rotation of the drive screw 88 to move inwardly and outwardly to open and close the shutter plates 82. Of course, it will be understood that, while the drive screw 88 in the described embodiment is manually driven, other methods of rotating the drive screw 88 are contemplated by the present invention, including, but not limited to, electric, hydraulic, or pneumatic motor drives. The shutter assembly 80 at the material exit end of the apparatus is substantially identical in construction and operation, with a series of linked shutter plates mounted to the dividing walls at the exit end of the pressure chamber and each downstream subchamber 32',32''.

During a material thread-up operation, the drive wheels 90 of the shutter assemblies are rotated to cause their drive screws 88 to move inwardly and open their shutter plates 82. The shutter plates 82 are supported in the open position by the drive screw 88 which remains in contact with the first orifice plate 82. When all shutter plates 82 are open at each end of the apparatus, the textile material is passed through the apparatus. The drive screws 90 are then rotated in reverse to close the shutter plates 82 whereupon normal material processing operation of the apparatus may proceed with the material traveling through the narrow passageways 87.

Of course, those persons skilled in the art will readily recognize that numerous other variations of the present invention are possible. By way of example and without limitation, the present apparatus can be utilized for applying substantially any treating fluid under pressure to a traveling textile strand, in addition to the preferred embodiment described herein utilizing saturated pressurized steam. The relative size and number of sealing subchambers can be varied as necessary or desirable for differing treatment purposes and embodiments. It is presently contemplated that between one and twenty sealing subchambers at the upstream and downstream sides of the pressure chamber would accommodate most, if not all, potential embodiments of the present apparatus for differing treatment purposes on differing textile strand materials. It is also contemplated that a fewer number of upstream sealing subchambers than downstream sealing subchambers can be utilized when steam or a similar fluid is utilized as the treating fluid because of the tendency of the cooler incoming strand to condense and depressurize escaping steam within the upstream subchambers. The size of the passageways 38 within the nozzle plates 34 and the passageways 87 between the shutter and dividing plates 82,84 can be selectively varied to accommodate differing types and sizes of yarns, strands, and other textile materials and to produce differing desired pressure drops between the chambers. Basically, each passageway 38,87 should be of a cross-sectional size and shape sufficient for passage therethrough of the particular size and type of textile material being treated without the nozzle plates 34 or the shutter and dividing plates 82,84 contacting the traveling material during ongoing operation, yet the passageways 38,87 should be sufficiently constricted to effectively resist and minimize escape of steam or other pressurized treating fluid through the passageways 38,87. By way of example, for most filamentary textile strands such as polyester, nylon, and the like, up to about 200 denier in size, it is believed that passageways up to about 1.5 millimeters in diameter will produce optimal results in the particular embodiment illustrated and described. For carpet yarns and the like, e.g., higher denier yarns on the order of about 1,300 denier single-ply or 2,600 denier two-ply, passageways in the range of about 1.0 to 2.5 millimeters in diameter are preferred.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An apparatus for treating a traveling extended-length textile material in a pressurized fluid comprising housing means defining a series of chambers for traveling movement of the strand successively therethrough without intentional contact of the strand with said housing means, said chambers comprising in series an upstream sealing chamber, a treatment chamber, and a downstream sealing chamber, said housing means including means defining a constricted material passageway to each opposite end of each chamber for fluid communication and flow between said chambers, and means communicating with said treatment chamber for delivering a supply of a pressurized material treating fluid thereto, each said sealing chamber being sufficiently enlarged in volume in relation to each constricted passageway at its opposite ends for sufficient expansion within said sealing chambers of said pressurized treating fluid escaping thereinto from said treatment chamber to generally seal said housing means from substantial loss of said pressurized treating fluid and to substantially maintain pressurization of said treatment chamber.

2. An apparatus for treating traveling textile material in a pressurized fluid according to claim 1 wherein said means for delivering said pressurized treating fluid to said treatment chamber comprises means for generating a supply of saturated steam as said supply of pressurized treating fluid.

3. An apparatus for treating traveling textile material in a pressurized fluid according to claim 2 and wherein said means for delivering said pressurized treating fluid to said treatment chamber further comprises means for detecting temperature of said steam and means for regulating said delivery of steam in relation to said detected temperature.

4. An apparatus for treating traveling textile material according to claim wherein said means for delivering said pressurized treating fluid to said treatment chamber comprises an annular fluid holding chamber formed in said housing annularly about said treatment chamber, said treating fluid supply communicating with said holding chamber and said holding chamber communicating at a spaced location with said treatment chamber.

5. An apparatus for treating traveling textile material in a pressurized fluid according to claim 1 and further comprising a plurality of said sealing chambers downstream of said treatment chamber.

6. An apparatus for treating traveling textile material in a pressurized fluid according to claim wherein each said constricted passageway is of increasing dimension in the direction outwardly away from said treatment chamber to promote expansion within said sealing chambers of said pressurized treating fluid escaping thereinto.

7. An apparatus for treating traveling textile material in a pressurized fluid according to claim 1 and further comprising nozzle means at the downstream end of said housing and means for selectively delivering pressurized fluid to said nozzle means for creating sufficient negative pressure within said series of chambers for suction thread-up of the material therethrough preliminary to operation of said apparatus.

8. An apparatus for treating traveling textile material in a pressurized fluid according to claim 7 and further comprising means for delivering a coolant to said nozzle means for application to the material while traveling through said apparatus during normal operation.

9. An apparatus for treating traveling textile material in a pressurized fluid according to claim 7 and further comprising means for selectively delivering pressurized fluid to said nozzle means at a relatively higher rate of delivery for suction thread-up of a material and at a relatively lower rate of delivery for cooling of the material upon discharge from said apparatus during normal operation.

10. An apparatus for treating traveling textile material according to claim 1 and further comprising means for threading the material through said apparatus preliminary to operation of said apparatus.

11. An apparatus for treating traveling textile material according to claim 10 wherein said means for threading the material through said apparatus includes a threading implement to which a leading end of the material is attached for guiding passage of the leading end of the material through said housing means for thread-up thereof.

12. An apparatus for treating traveling textile material according to claim 10 wherein said means for threading material through said apparatus includes means for selectively enlarging temporarily said passageway at said sealing chambers providing enhanced ease of thread-up preliminary to operation of said apparatus.

13. An apparatus for treating traveling textile material according to claim 12 wherein said means for enlarging said passageway includes shutter means disposed adjacent said passageways and actuator means for selectively opening and closing said shutter means to selectively enlarge and constrict said passageways.

14. An apparatus for treating traveling textile material according to claim 13 wherein said actuator means includes reciprocable drive means for contacting and pushing said shutter means into an open position.

15. An apparatus for treating a traveling textile material in a pressurized fluid according to claim 1 and further comprising pressure relief means associated with at least one said sealing chamber for controlled venting thereof to the exterior of said housing means.

16. An apparatus for treating a traveling textile material in a pressurized fluid according to claim 1 and wherein each said constricted passageway is dimensioned to be sufficiently larger in cross-sectional area than the material to be treated in said apparatus yet sufficiently constricted to control escape of pressurized treating fluid through said passageway.

17. An apparatus for treating a traveling textile material in a pressurized fluid according to claim 1 and further comprising means communicating with at least one of said sealing chambers for delivering another supply of pressurized fluid thereto to retard escape of said pressurized treating fluid from said treatment chamber.

18. An apparatus for treating a traveling textile material in a pressurized fluid according to claim 17 and wherein said means for delivering another supply of pressurized fluid is communicated with said downstream sealing chamber.

19. An apparatus for treating a traveling textile material in a pressurized fluid according to claim 18 and wherein said means for delivering another supply of pressurized fluid comprises means for selectively delivering a pressurized gas or a pressurized liquid or a mixture thereof to said downstream sealing chamber.

20. An apparatus for treating a traveling textile material in a pressurized fluid according to claim 18 wherein said means for delivering another supply of pressurized fluid is not communicated with said upstream chamber.

21. An apparatus for treating a traveling textile material in a pressurized fluid according to claim 17 and further comprising a plurality of said sealing chambers downstream of said treatment chamber and means communicating with the most downstream one of said downstream sealing chambers for delivering another supply of pressurized fluid thereto to retard escape of said pressurized treating fluid from said treatment chamber and from the other said downstream sealing chambers.

* * * * *

UNITED STATES PATENT AND TRADEMARK OFFICE

CERTIFICATE OF CORRECTION

PATENT NO. : 5,287,606

DATED : February 22, 1994

INVENTOR(S) : Helmut Ruef

It is certified that error appears in the above-identified patent and that said Letters Patent is hereby corrected as shown below:

Column 12, line 37, after "claim" insert -- 1 --.

Column 12, line 49, after "claim" insert -- 1 --.

Signed and Sealed this

Thirteenth Day of September, 1994

*Attest:*

*Attesting Officer*

Bruce Lehman

BRUCE LEHMAN

*Commissioner of Patents and Trademarks*